United States Patent [19]

Yarwood et al.

[11] 4,158,379

[45] Jun. 19, 1979

[54] ELECTROMAGNETIC CASTING METHOD AND APPARATUS

[75] Inventors: John C. Yarwood, Madison; Ik Y. Yun, Orange; Derek E. Tyler, Cheshire, all of Conn.

[73] Assignee: Olin Corporation, New Haven, Conn.

[21] Appl. No.: 921,298

[22] Filed: Jul. 3, 1978

[51] Int. Cl.[2] ..... B22D 11/124; B22D 27/02

[52] U.S. Cl. ..... 164/49; 164/147; 164/89; 164/444; 164/251

[58] Field of Search ..... 164/82, 48, 49, 146, 164/147, 250, 251, 418, 89, 444

[56] References Cited

U.S. PATENT DOCUMENTS 3,646,988 3/1972 Getselev ..... 164/251

*Primary Examiner*—Othell M. Simpson
*Assistant Examiner*—K. Y. Lin
*Attorney, Agent, or Firm*—Paul Weinstein

[57] ABSTRACT

A method and apparatus for electromagnetic continuous or semicontinuous casting of metals and alloys. A coolant application system may be adjustably positioned to control the solidification front at the surface of the casting without otherwise influencing the containment process through modification of the magnetic field.

11 Claims, 1 Drawing Figure

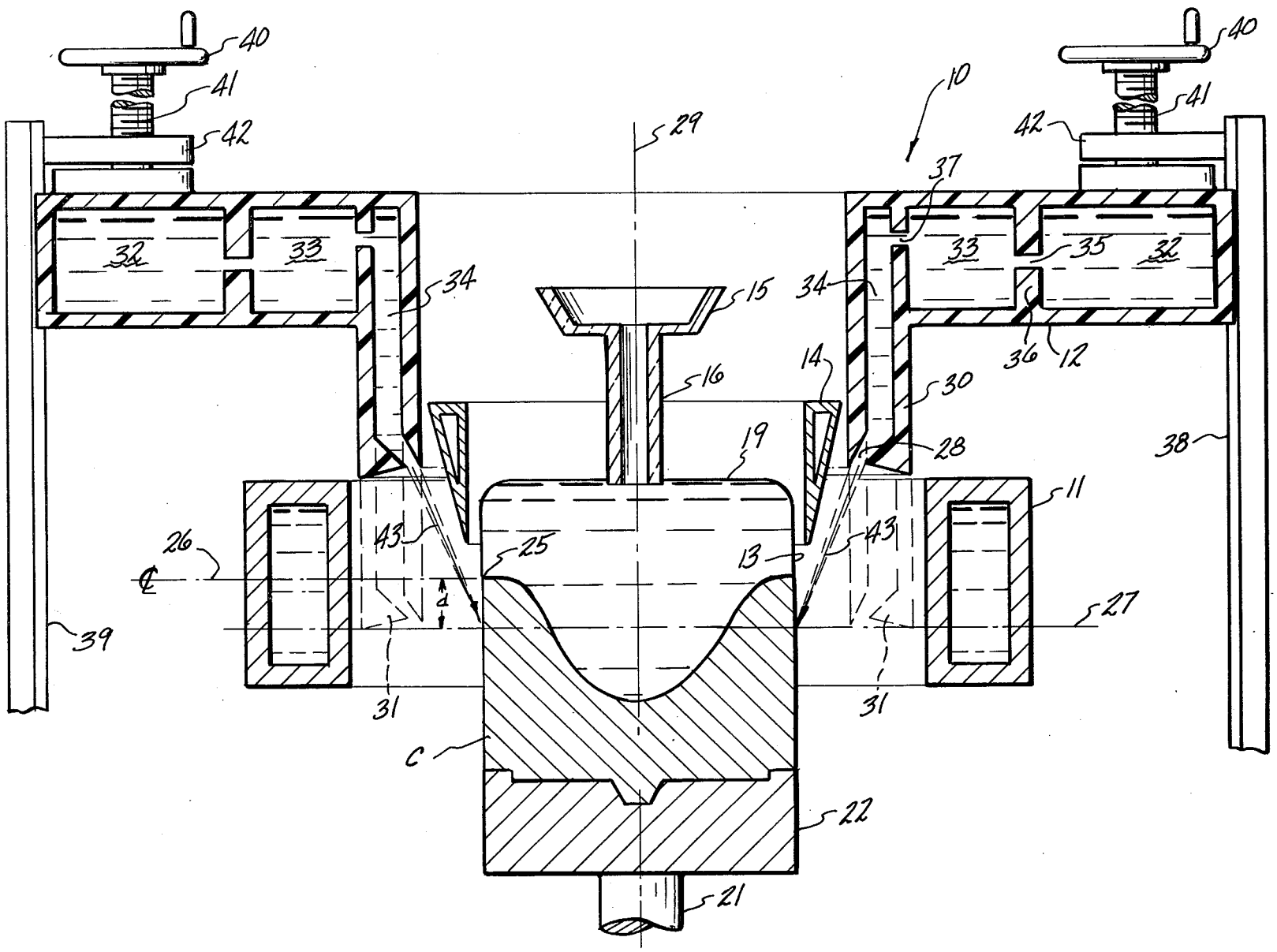
10
11
12
13
14
15
16
19
21
22
25
26
27
28
29
30
31
32
33
34
35
36
37
38
39
40
41
42
43
C

ELECTROMAGNETIC CASTING METHOD AND APPARATUS

BACKGROUND OF THE INVENTION

This invention relates to an improved process and apparatus for electromagnetically casting metals and alloys particularly heavy metals and alloys such as copper and copper alloys. The electromagnetic casting process has been known and used for many years for continuously and semicontinuously casting metals and alloys. The process has been employed commercially for casting aluminum and aluminum alloys.

PRIOR ART STATEMENT

The electromagnetic casting apparatus comprises a three part mold consisting of a water cooled inductor, a non-magnetic screen and a manifold for applying cooling water to the ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

The cooling manifold may direct the water against the ingot from above, from within or from below the inductor as exemplified in U.S. Pat. Nos. 3,735,799 to Karlson and 3,646,988 to Getselev. In some prior art approaches the inductor is formed as part of the cooling manifold so that the cooling manifold supplies both cooling to solidify the casting and to cool the inductor as exemplified in U.S. Pat. Nos. 3,773,101 to Getselev and 4,004,631 to Goodrich et al.

The non-magnetic screen is utilized to properly shape the magnetic field for containing the molten metal as exemplified in U.S. Pat. No. 3,605,864 to Getselev. A variety of approaches with respect to non-magnetic screens are exemplified as well in the Karlson '799 patent and in U.S. Pat. No. 3,985,179 to Goodrich et al. Goodrich et al. '179 describes the use of a shaped inductor to shape the field. Similarly, a variety of inductor designs are set forth in the aforenoted patents and in U.S. Pat. No. 3,741,280 to Kozheurov et al.

While the above described patents describe electromagnetic casting molds for casting a single strand or ingot at a time the process can be applied to the casting of more than one strand or ingot simultaneously as exemplified in U.S. Pat. No. 3,702,155. In addition to the aforenoted patents a further description of the electromagnetic casting process can be found by reference to the following articles: "Continuous Casting with Formation of Ingot by Electromagnetic Field", P. P. Mochalov and Z. N. Getselev, Tsvetnye Met., August, 1970, 43, pp. 62–63; "Formation of Ingot Surface During Continuous Casting", by G. A. Balakhontsev et al., Tsvetnye Met., August 1970, 43, pp. 64–65; "Casting in an Electromagnetic Field", by Z. N. Getselev, J. of Metals, October, 1971, pp. 38–59; and "Alusuisse Experience with Electromagnetic Moulds", by H. A. Meier, G. B. Leconte and A. M. Odok, Light Metals, 1977, pp. 223–233.

In U.S. Pat. No. 4,014,379 to Getselev a control system is described for controlling the current flowing through the inductor responsive to deviations in the dimensions of the liquid zone (molten metal head) of the ingot from a prescribed value. In Getselev '379 to inductor voltage is controlled to regulate the inductor current in response to measured variations in the level of the surface of the liquid zone of the ingot. Control of the inductor voltage is achieved by an amplified error signal applied to the field winding of a frequency changer.

The invention herein is particularly concerned with the apparatus for applying colling water to the ingot for solidification. It is known for electromagnetic casting that the solidification front between the molten metal and the solidifying ingot at the ingot surface should be maintained within the zone of high magnetic field strength. Namely, the solidification front should be located within the inductor. If the solidification front extends above the inductor, cold folding is likely to occur. On the other hand, if it recedes to below the inductor, a bleed out or decantation of the liquid metal is likely to result.

In Getselev et al. '166 the coolant application manifold is associated with the screen portion of the mold and they are arranged for simultaneous movement relative to the inductor. This is not a suitable system for adjusting the water application plane since movement of the coolant manifold entails corresponding movement of the screen which results in undesirable modification in the field shape of the mold and, hence, in the resulting ingot shape. In Getselev '988 there is disclosed a moveable manifold mounted below the inductor. This system would appear adequate for high conductivity alloys especially where low casting speeds are used. However, the apparatus described provides a minimum separation between the plane of water application and the inductor mid-plane comprising one-half the height of the inductor. If this apparatus were applied to copper alloys of moderate or fairly low conductivity, then in order to properly position the plane of coolant application, it would be necessary to use an impractically short inductor height unless restrictively low casting speeds were employed.

SUMMARY OF THE INVENTION

In accordance with the method and apparatus of this invention the above-noted deficiencies are overcome by providing a water cooling means that may be adjustably positioned to control the solidification front at the surface of the ingot without otherwise influencing the containment process through modification of the magnetic field. The water cooling means of this invention is arranged to direct the water stream onto the surface of the ingot from a manifold situated essentially above the inductor and which extends between the inductor and the non-magnetic screen. The manifold is capable of movement in a direction axially of the casting to adjust the location of the plane of water impact.

Accordingly it is an object of this invention to provide an improved method and apparatus for the electromagnetic casting of metals and alloys.

It is a further object of this invention to provide an improved method and apparatus as above for controlling the position of the solidification front.

These and other objects will become more apparent from the following description and drawing.

BRIEF DESCRIPTION OF THE DRAWING

The FIGURE is a schematic representation of an electromagnetic casting apparatus in accordance with this invention.

DETAILED DESCRIPTION OF PREFERRED EMBODIMENTS

Referring now to the FIGURE there is shown by way of example an electromagnetic casting apparatus of this invention.

The electromagnetic casting mold 10 is comprised of an inductor 11 which is water cooled; a coolant manifold 12 in accordance with this invention for applying cooling water to the peripheral surface 13 of the metal being cast C; and a non-magnetic screen 14. Molten metal is continuously introduced into the mold 10 during a casting run, in the normal manner using a trough 15 and down spout 16 and conventional molten metal head control. The inductor 11 is excited by an alternating current from a suitable power source (not shown).

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic screen 14 is to fine tune and balance the magnetic pressure with the hydrostatic pressure of the molten metal head 19. The non-magnetic screen 14 comprises a separate element as shown, and is not a part of the manifold 12 for applying the coolant.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. In the embodiment which is shown in the FIGURE the water is applied to the ingot surface 13 within the confines of the inductor 11. The water may be applied to the ingot surface 13 from above, within or below the inductor 11 as desired.

The solidification front 25 of the casting comprises the boundary between the molten metal head 19 and the solidified ingot C. It is most desirable to maintain the solidification front 25 at the surface 13 of the ingot C at or close to the plane of maximum magnetic flux density which usually comprises the plane passing through the electrical centerline 26 of the inductor 11. In this way, the maximum magnetic pressure opposes the maximum hydrostatic pressure of the molten metal head 19. This results in the most efficient use of power and reduces the possibility of cold folds or bleed outs.

The location of the solidification front 25 at the ingot surface 13 results from a balance of the heat input from the superheated liquid metal 19 and the resistance heating from the induced currents in the ingot surface layer, with the longitudinal heat extraction resulting from the cooling water application. The location of the front 25 can be characterized with reference to its height "d" above the location of the coolant application plane 27. Hence, the plane of cooling water application 27 can be referenced to the electrical centerline 26 of the inductor. That distance "d" depends on a multiplicity of factors. "d" decreases with increasing: latent heat of solidification of the alloy being cast; specific heat of the alloy; electrical resistivity of the alloy; molten metal head height; inductor height; inductor current amplitude; inductor current frequency; casting speed; and with decreasing alloy conductivity and visa versa.

For a given alloy, the physical properties, latent heat of solidification, specific heat, thermal conductivity, and electrical resistivity are more or less fixed. Normal electromagnetic casting practice would fix the inductor 11 current frequency within limits, the geometrical arrangement of the inductor 11 and its height, the molten metal heat 19 height and the inductor 11 current amplitude. It follows, therefore, that the only remaining major process control variable affecting the position of the solidification front 25 at the surface 13 of the ingot "C" is the casting speed. Therefore, it would be necessary to adjust the casting speed in order to adjust the position of the solidification front 25 to the favorable location corresponding to the plane through the centerline 26 of the inductor 11. However, in practice other factors such as cracking and formation of undesirably coarse microstructures limit the range of casting speeds which can be used.

Therefore, in accordance with this invention the problem of maintaining the solidification front 25 at its desired position is overcome by adjusting the plane of water application 27 with respect to the inductor 11. This technique allows adjustment of the position of the solidification front 25 location independent of casting speed and alloy properties.

In accordance with this invention the coolant manifold 12 is arranged above the inductor and includes at least one discharge port 28 for directing the coolant against the surface 13 of the ingot or casting. The discharge port 28 can comprise a slot or a plurality of individual orifices for directing the coolant against the surface 13 of the ingot C about the entire periphery of that surface.

In order to provide a means for controlling the solidification front 25 at the surface 13 of the ingot C without influencing the containment of the molten metal through modification of the magnetic field, the coolant manifold 12 with its discharge port 28 is arranged for movement axially of the ingot C. The coolant manifold 12, the inductor 11 and the non-magnetic screen 14 are all arranged coaxially about the longitudinal axis 29 of the ingot C. In the preferred embodiment shown the coolant manifold 12 includes an extended portion 30 which includes the discharge port 28 at its free end. The extended portion 30 of the coolant manifold 12 is arranged for movement between the non-magnetic screen 14 and the inductor 11 in the direction defined by the axis of the ingot C.

The inductor 11 and the non-magnetic screen 14 are supported by conventional means known in the art (not shown). The coolant manifold 12 is supported for movement independently of the inductor 11 and the non-magnetic screen 14 so that the position of the discharge port 28 can be adjusted axially of the ingot without a concurrent movement of the non-magnetic screen 14 or inductor 11. This is a significant departure from the approaches described in the prior art wherein the non-magnetic screen 14 is supported by the coolant manifold 12 and both are arranged for simultaneous movement in the axial sense.

By moving the discharge port 28 of the coolant manifold independently of the non-magnetic screen 14 in accordance with this invention it is possible to adjust the position of the solidification front 25 without modifying the magnetic containment field. In the preferred embodiment shown in the FIGURE the discharge port 28 is arranged for axial movement between the non-magnetic screen 14 and the inductor 11 along the path 31 as shown in phantom.

Another feature of the present invention is that the coolant manifold or at least that portion of the manifold which enters the magnetic field is formed of a material which will not modify the magnetic field. Preferably, it is formed of a non-conductive material such as plastic or resinous materials including phenolics.

In the embodiment shown in the FIGURE the coolant manifold 12 includes three chambers 32, 33 and 34. The coolant enters the manifold 12 in the first chamber 32. A slot or a plurality of orifices 35 arranged in the wall 36 between the first chamber 32 and the second chamber 33 serve to enhance the uniformity of the distribution of the coolant in the manifold 12. Similarly, slots or orifices 37 between the second 33 and the third chamber 34 further enhance the uniformity of distribution of the coolant in the manifold 12. The coolant is discharged from the axially extended third chamber 34 via the discharge port 28. The manifold 12 including the extended third chamber 34 is arranged for movement along vertically extending rails 38 and 39 so that the extended portion 30 of the manifold can be moved between the inductor 11 and the screen 14 along the path 31 as shown in phantom.

Axial adjustment of the discharge port 28 position is provided by means of cranks 40 mounted to screws 41. The screws are rotatably secured to the manifold 12 at one end and are held in threaded engagement in support blocks 42 which are mounted to the rails 38. In this manner turning the cranks 40 in one direction or the other will move the manifold 12 and discharge port 28 axially up or down.

The coolant is discharged against the surface of the casting in the direction indicated by arrows 43 to define the plane of coolant application. By moving the discharge port 28 up or down in the manner described above the plane of coolant application is also moved up or down respectively with respect to the centerline 26 of the inductor 11 to thereby change the distance "d".

Copper alloy ingots are typically cast in 6"×30" cross sections at speeds at from about 5 to 8" per minute. Over this restricted speed range the preferred and most preferred water application zones for three common copper alloys have been calculated as follows:

TABLE I

| | Calculated Water Cooling Application Zone | | | | | |
|---|---|---|---|---|---|---|
| Alloy | Preferred | | | Most Preferred | | |
| C 11000 | − ½" | → | − 2" | − ¾ | → | − 2" |
| C 26000 | 0 | → | − 1¼" | − ¼" | → | − 1" |
| C 51000 | + ⅜" | → | − ¾" | + ⅛" | → | − ½" |

The measurements provided in Table I are for the distance from the centerline of the inductor to the plane of the coolant application. The values are negative or positive, respectively, depending on whether the plane of coolant application is arranged below or above the centerline of the inductor.

While it is most preferred in accordance with this invention to form the entire manifold 12 from a non-conductive material one could, if desired, form only that portion of the manifold 12 which would interact with the magnetic field from the non-conductive material while using other materials such as metals for the remaining portion of the manifold 12. For example, if desired, only the chamber 34 need be formed fron non-conductive material, whereas the chambers 32 and 33 could be formed from any desired material. The chamber 34 would then be joined to the chambers 32 and 33 in a conventional manner. Therefore, in accordance with this invention it is only necessary that the portion of the coolant application means which would interact with the magnetic field be formed from a non-conductive material.

The method of continuously or semicontinuously casting metals and alloys of the present invention involves the adjustment in an axial sense of the position of the manifold 12 and in particular, the discharge port 28 therein, prior to the beginning of a casting run in order to position the solidification front 25 at an appropriate axial position for the alloy being cast. It is preferred that this adjustment take place prior to the beginning of the casting run. However, if desired, the adjustment can be refined during a casting run. The discharge port 28 must be moved independently of the inductor 11 and screen 14 so that its change in position does not affect the magnetic field or the containment process.

The method and apparatus of this invention is particularly adapted to the continuous or semicontinuous casting of metals and alloys. Further details of the apparatus and method of electromagnetic casting can be gained from a consideration of the various patents and publications cited in this application, which are intended to be incorporated by reference herein.

While the invention has been described with reference to copper and copper base alloys it is believed that the apparatus and method described above can be applied to a wide range of metals and alloys including nickel and nickel alloys, steel and steel alloys, aluminum and aluminum alloys, etc.

It is apparent that there has been provided in accordance with this invention an electromagnetic casting apparatus and method which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for continuously or semicontinuously casting metals comprising:

means for electromagnetically containing molten metal and for forming said molten metal into a desired casting, said electromagnetically containing and forming means including: an inductor for applying a magnetic field to said molten metal; and a non-magnetic screen means for shaping said magnetic field, said screen means being arranged coaxially with said inductor; said apparatus further including means for applying coolant to said casting for solidifying said molten metal, said coolant applying means including a manifold and at least one coolant discharge port connected to said manifold for directing said coolant against said casting; said inductor and said coolant applying means being coaxially arranged about an axis of said casting which defines a desired axial direction; the improvement wherein, said apparatus further includes:

means for controlling the position of a solidification front in said axial direction at a surface of said casting, said means for controlling said position of said solidification front comprising means for adjustably supporting said at least one coolant discharge port for movement in said axial direction between said inductor and said non-magnetic screen means independently of said electromagnetically containing and forming means; whereby the position at which the coolant is applied to said surface of said casting can be adjusted to control the position of said solidification front without modifying said magnetic field.

2. An apparatus as in claim 1 wherein at least a portion of said manifold which interacts with said magnetic field is formed of a material which will not substantially modify said field.

3. An apparatus as in claim 2 wherein said entire manifold is formed of said material.

4. An apparatus as in claim 2 wherein said material is substantially electrically non-conductive.

5. An apparatus as in claim 4 wherein said material comprises a plastic.

6. An apparatus as in claim 2 wherein said portion of said manifold includes said coolant discharge port.

7. An apparatus as in claim 1 wherein said manifold is arranged above said inductor and wherein said screen means is arranged coaxially with said coolant application means.

8. An apparatus as in claim 1 wherein said manifold includes an axially extended portion including said coolant discharge port and wherein said extended portion is arranged for said movement between said inductor and said non-magnetic screen means.

9. In a method for continuously and semicontinuously casting metals comprising:

electromagnetically containing and forming molten metal into a desired casting, said electromagnetically containing and forming step including the steps of:

providing an inductor for applying a magnetic field to molten metal and providing a non-magnetic screen for shaping said magnetic field; and applying said magnetic field to said molten metal; said method further comprising:

applying coolant to said casting for solidifying said molten metal, said coolant applying step including the step of providing a coolant discharge port for directing said coolant against said casting; and controlling the position of a solidification front at a surface of said casting, said controlling step including the step of adjusting the position of said coolant discharge port without substantially modifying said magnetic field by moving said discharge port between said non-magnetic screen and said inductor and independently thereof.

10. A method as in claim 9 wherein said inductor, said non-magnetic screen and said discharge port are coaxially arranged about an axis of said casting which defines an axial direction and wherein said discharge port is moved in said axial direction.

11. A method as in claim 10 including the step of forming said discharge port from a material which will not interact substantially with said magnetic field.

* * * * *